US009394761B2

(12) United States Patent
Al-Ajmi et al.

(10) Patent No.: US 9,394,761 B2
(45) Date of Patent: Jul. 19, 2016

(54) FLEXIBLE ZONE INFLOW CONTROL DEVICE

(71) Applicant: Saudi Arabian Oil Company, Dhaharan (SA)

(72) Inventors: Fahad A. Al-Ajmi, Dhahran (SA); Sultan S. Al-Madani, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 320 days.

(21) Appl. No.: 14/045,035

(22) Filed: Oct. 3, 2013

(65) Prior Publication Data

US 2015/0096762 A1 Apr. 9, 2015

(51) Int. Cl.

| | |
|---|---|
| ***E21B 34/14*** | (2006.01) |
| ***E21B 41/00*** | (2006.01) |
| ***E21B 34/06*** | (2006.01) |

(52) U.S. Cl.

CPC ..... *E21B 34/14* (2013.01); *E21B 34/063* (2013.01); *E21B 41/0078* (2013.01)

(58) Field of Classification Search

CPC ..... E21B 34/06; E21B 34/063; E21B 34/12; E21B 34/14; E21B 41/0078

See application file for complete search history.

(56) References Cited

U.S. PATENT DOCUMENTS

| | | | | |
|---|---|---|---|---|
| 3,799,258 | A | 3/1974 | Tausch | |
| 3,882,935 | A | 5/1975 | Calhoun | |
| 5,392,862 | A | 2/1995 | Swearingen | |
| 5,511,617 | A | 4/1996 | Snider | |
| 6,253,861 | B1 | 7/2001 | Carmichael | |
| 7,665,545 | B2 | 2/2010 | Telfer | |
| 8,397,820 | B2 | 3/2013 | Fehr | |
| 2008/0135255 | A1* | 6/2008 | Coronado | E21B 34/102 166/323 |
| 2010/0000727 | A1 | 1/2010 | Webb et al. | |
| 2012/0247767 | A1 | 10/2012 | Themig | |
| 2013/0014953 | A1 | 1/2013 | van Petegem | |
| 2013/0043038 | A1 | 2/2013 | Shaw et al. | |
| 2013/0068467 | A1 | 3/2013 | Zhou | |

FOREIGN PATENT DOCUMENTS

| | | |
|---|---|---|
| WO | 2009132462 | 11/2009 |
| WO | 2012037645 | 3/2012 |
| WO | 2012082305 | 6/2012 |
| WO | 2013037055 A1 | 3/2013 |

OTHER PUBLICATIONS

PCT International Search Report and the Written Opinion; dated May 21, 2015; International Application No. PCT/US2014/057963; International File Date: Sep. 29, 2014.

* cited by examiner

*Primary Examiner* — Brad Harcourt

(74) *Attorney, Agent, or Firm* — Constance Gall Rhebergen Bracewell LLP

(57) ABSTRACT

A device for controlling fluid flow from a subsurface fluid reservoir into a production tubing siring includes a tubular member defining a central bore. At least one nozzle extends through a side wall of the tubular member. A popper is moveable between an open position where fluids can flow into the central bore through the nozzle, and a closed position where the nozzle is fluidly sealed. A circumferential external bead profile is located on the stem and a circumferential groove is located in the nozzle for mating with the head profile of the stem and maintaining the popper in a closed position. The device can also have a shear member disposed between the stem of the popper and an inner surface of the nozzle for supporting the popper in an open position before the popper is moved to the closed position.

18 Claims, 3 Drawing Sheets

FLEXIBLE ZONE INFLOW CONTROL DEVICE

BACKGROUND OF THE INVENTION

1. Field of the Invention

The present invention relates to operations in a wellbore associated with the production of hydrocarbons. Mors specifically, the invention relates to controlling the inflow of a production fluid into a wellborn and the injection of fluids into a subterranean formation through the wellbore.

2. Description of the Related Art

Often in the recovery of hydrocarbons from subterranean formations, wellbores are drilled with highly deviated or horizontal portions that extend through a number of separate hydrocarbon-bearing production zones. Each of the separate production zones can have distinct characteristics such as pressure, porosity and water content, which, in some instances, can contribute to undesirable production patterns. For example, if not properly managed, a first production zone with a higher pressure can deplete earlier than a second, adjacent production zone with a lower pressure. Since nearly depleted production zones often produce unwanted water that can impede the recovery of hydrocarbon containing fluids, permitting the first production zone to deplete earlier than the second production zone can inhibit production from the second production zone and impair the overall recovery of hydrocarbons from the wellbore.

One traditional solution in dealing with an increase In water cut is to reduce the choke setting at the wellhead. This will lower draw-down pressure and oil production but it will bring higher cumulative oh recovery. However, this simple solution generally does not work in wells drilled at high angles. One technology that has been developed to manage the inflow of fluids from various production zones involves the use of downhole inflow control tools such as inflow control devices ("ICDs"). ICDs can be used to cause equal contribution from each zone either in production or injection phases. After drilling and completing the well, the efficiency of the ICDs can be tested by running production logging tools to check the performance of the completion.

In intelligent field applications, the operators can shut off or reduce flow rate from such offending zones using remotely actuated down-hole valves. But horizontal wells designed to optimize reservoir exposure are often poor candidates for a similar strategies. For example, for long wells with multiple zones, the limit on the number of wellhead penetrations available may render it impossible to deploy enough down-hole control valves to be effective. Moreover, with completions which are considered to be expensive, complex and fraught with risk when installed in long, high-angle sections, it is highly needed to fed a way to reduce risk optimize cost and comply with production rate that is promised to be delivered.

Therefore operators can produce from these multi-zone weds using isolating devices such as swell able packers to mitigate cross-flow and to promote uniform flow through the reservoir. A combination of passive inflow control devices in combination with swellable packers can be used. The ICD will create higher drawdown pressure and thus higher flow rates along the borehole sections which are more resistant to flow. As result of that, the ICD will correct the uneven flow which is caused by the head-to-toe effect and heterogeneity of the rock.

However in more mature wells that are completed with an ICD when water is dominating the flow from multiple zones, such zones must be de-completed, or re-completed with blank pipes over the intervals of such zones. A work over operation is traditionally needed to perform such operations. However, this operation will be costly and the risks associated with performing such operations, such as cementing those zones, and the reliability of the post-performance will play a factor in the success of the jobs. Choosing not to perform such operations and leaving those water zones without treatment can lead to demanding and major upgrades in the water management systems and facilities.

SUMMARY OF THE INVENTION

The apparatus and method of this disclosure will provide a solution for shutting off production or injection in unwanted zones through a mechanical means. This invention can be utilized with an ICD and with multi-zone wells. Therefore, this invention provides an efficient and cost effective alternative to de-completing or re-completing individual zones.

A device for sealing fluid flow from a subsurface fluid reservoir into a production tubing string in accordance with an embodiment of this invention includes a tubular member defining a central bore, wherein a first end and a second end of the tubular member are coupled to the production tubing string. At least one nozzle extends through a side wall of the tubular member. The device includes a popper which is moveable between an open position where fluids can flow into the central bore through the nozzle, and a closed position where the nozzle is fluidly sealed. The popper has a stem with an outer diameter less than an inner diameter of the nozzle. The popper has a hat located at an end of the stem. A circumferential external bead profile is located on the stem and a circumferential groove is located in the nozzle for mating with the head profile of the stem and maintaining the popper in a closed position after the popper is moved from the open position to the closed position.

In certain embodiments, the device can have a shear member disposed between the stem of the poppet and an inner surface of the nozzle for supporting the popper in an open position before the popper is moved to the closed position. The hat can have an inward facing surface for contacting an outer surface of an inflatable vessel. The inward facing surface of the hat can be generally semi-spherical and the outer surface of the inflatable vessel can be conical. Contact between inward racing surface of the hat and outer surface of an inflatable vessel the will move the popper from an open position to a closed position. The hat can also have an outward facing surface for sealingly contacting an inner surface of the central bore. The outward facing surface of the hat will have a diameter greater than the inner diameter of the nozzle.

In alternative embodiments of the present invention, an inflow control device for controlling fluid flow from a subsurface fluid reservoir into a production tubing string includes a tubular member defining a central bore. A plurality of passages extend along the tabular member. The outflow of each passage is in fluid communication with a nozzle which is in fluid communication with the central bore. An annular opening is defined by the tubular member near as upstream end of the inflow control device, the annular opening allowing fluid communication between the subsurface fluid reservoir and the plurality of passages. A popper is moveable between an open position where fluids can flow into the central bore through the nozzle, and a closed position where the nozzle is fluidly sealed. A shear member is disposed between the stem of the popper and an inner surface of the nozzle for supporting the popper in an open position.

In certain embodiments, the popper has a stem having a first end and a second end. A hat can be located at a second end of the stem. The stem can have a circumferential external head profile. A circumferential groove can be located in the nozzle for mating with the head profile of the stem and maintaining the popper in a closed position after the popper is moved from the open position to the closed position. The hat can have an inward facing hat surface for contacting an outer tool surface of an inflatable vessel to move the popper from an open position to a closed position. The hat can also have an outward facing hat surface for sealingly contacting an inner bore surface of the central bore, the outward facing hat surface having a diameter greater than the inner diameter of the nozzle. The stem can have an outer diameter less than an inner diameter of the nozzle. The first end of the stem can be located within the nozzle in both the open and closed position.

In other alternative embodiments of the present invention, a method for sealing fluid flow from a subsurface fluid reservoir into a production tubing string includes the steps of connecting a first and second end of a tubular member to the production tubing string. The tubular member has a central bore with an axis and at least one nozzle extending through a side wall. A popper is located in the nozzle. A tool with an inflatable vessel is lowered through the production tubing string and into the tubular member. The tool is pressurized to expand the Inflatable vessel. The inflatable vessel is then pulled past the at least one nozzle to contact a bat of the popper, pushing a circumferential external head profile located on a stem of the popper info a circumferential groove located in the nozzle and moving tire popper from an open position where reservoir fluids can flow into the central bore through the nozzle, to a closed position where the nozzle is fluidly sealed.

In some embodiments, the inflatable vessel can be deflated and raised back up through the production tubing. The tubular member can be pressure tested. The tubular member can have a shear member disposed between the stem of the popper and an inner surface of the nozzle for supporting the popper in an open position. In such embodiment, pulling the inflatable vessel past the nozzle will cause the shear member to break. The inflatable vessel can be pulled in a direction co-axial to the axis of the central bore. The inflatable vessel can be lowered on coiled tubing.

In other embodiments, the step of pushing the head profile into the circumferential groove is accomplished by contacting an inward facing semi-spherical surface of the popper with an outer facing conical surface of the inflatable vessel. The popper can be pushed into the nozzle until an outward surface of the hat sealingly contacts an inner surface of the central bore.

BRIEF DESCRIPTION OF THE DRAWINGS

So that the manner in which the above-recited features, aspects and advantages of the invention, as wed as otters that will become apparent are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments or positions.

In the following discussion, numerous specific details are set forth to provide a thorough understanding of the present invention. However, it will be obvious to those skilled in the art that the present invention can be practiced without such specific details. Additionally, for the most part, details concerning well drilling, reservoir testing, well completion and the like have been omitted inasmuch as such details are not considered necessary to obtain a complete understanding of the present invention, and are considered to be within the skills of persons skilled in the relevant art.

Figure 1:
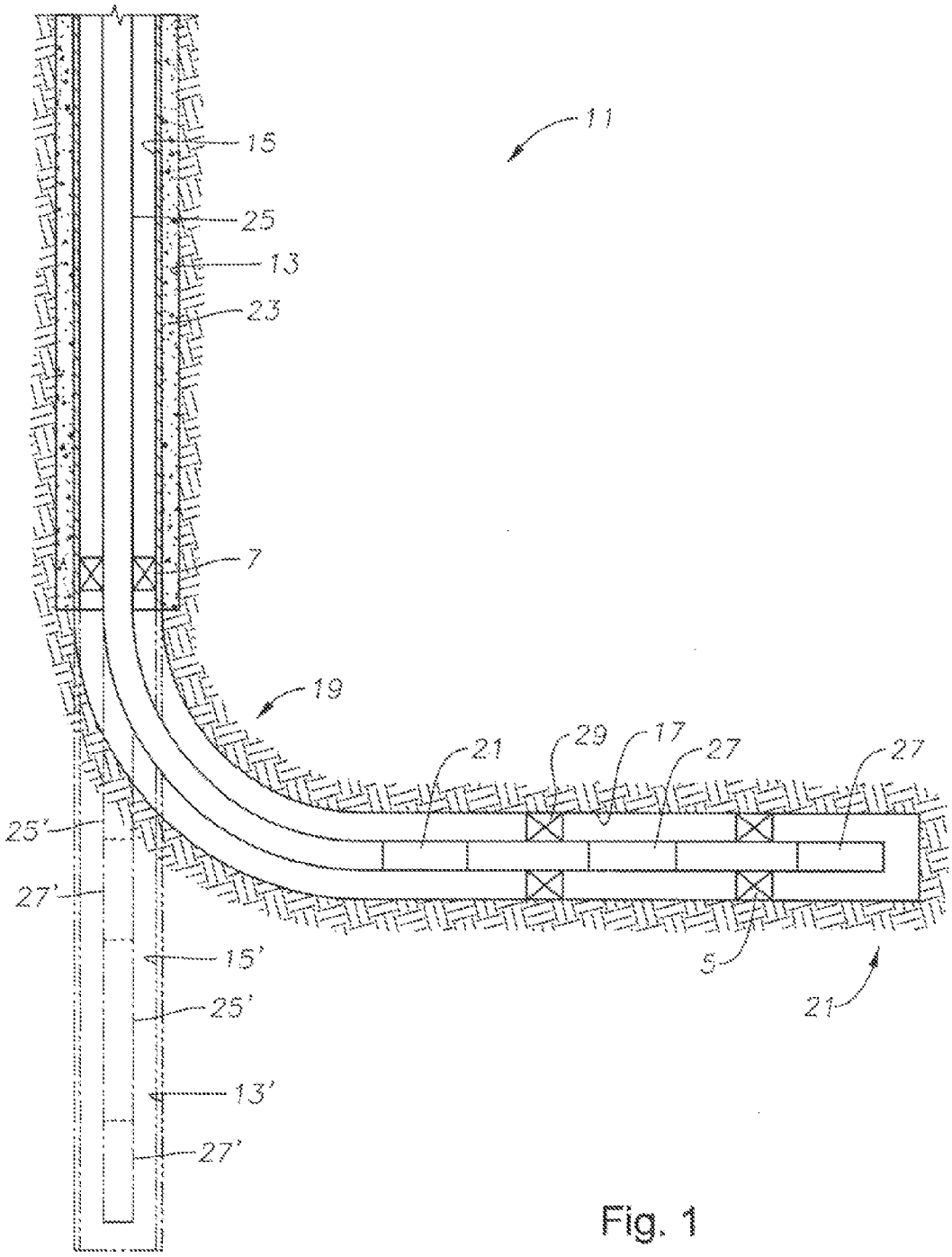
FIG. 1 is a schematic representation of a portion of a production well in accordance with an embodiment of the present invention.

Referring to FIG. 1, a well system 11 includes a wellbore 13 that is at least partially completed with a casing string 15. In the illustrated embodiment, wellbore 13 includes a lateral bore 17 having a heel 19 and a toe 21 extending horizontally from wellbore 13. Wellbore 13 can be installed with a easing string 15 cemented in place with a cement layer 23. Cement layer 23 can protect casing 15 and act as an isolation barrier. Lateral bore 17 can be uncased as shown. Alternatively lateral bore 17 can be completed with a easing string similar to casing string 15. A production tubing string 25 is suspended within casing string 15 and lateral bore 17. A production packer 7 placed within an annul us between production tubing string 25 and casing string 15 can isolate production tubing string 25 below an end of casing string 15.

Production tubing string 25 can include an inflow control device 27 (three of which are shown) to aid in the controlled flow of fluid from a formation surrounding lateral bore 11 into production tubing string 25 as described in more detail below. In the illustrated embodiment, each inflow control device 27 is isolated in a separate zone by an open hole packer 29, two of which are shown. Production tubing string 25 can be closed at toe 21, or alternatively include a packer on an upstream end of production tubing string 25 to prevent direct flow of reservoir fluids into-a bore of production tubing string 25. In alternative embodiments, shown in dashed lines in FIG. 1, wellbore 13 can not include lateral bore 17 and will extend vertically to a terminus of wellbore 13'. Casing string 15' can extend to the terminus of wellbore 13' and production tubing string 25', having inflow control devices 27', and will not include horizontal portions, but will complete the well in a vertical manner as shown.

Figure 2:
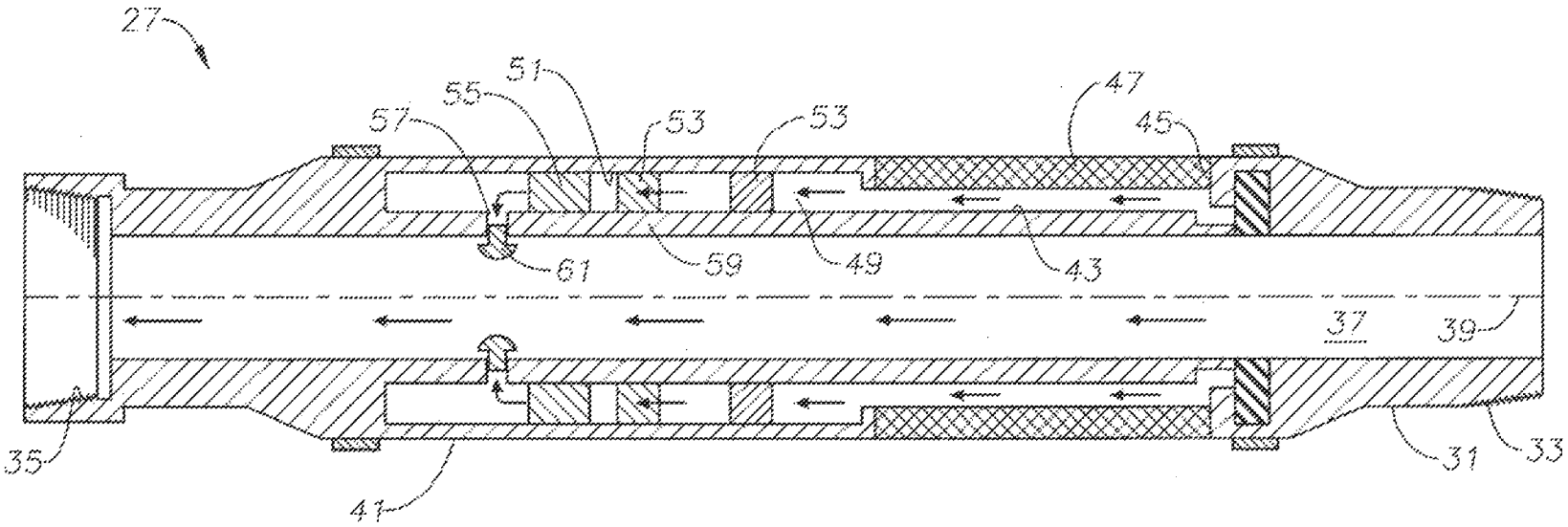
FIG. 2 is a sectional view of an Inflow control device during a production process in accordance with an embodiment of the present invention.

Referring to FIG. 2, inflow control device 27 is shown in a side sectional view. Although an embodiment of inflow device 2 will be described in further detail herein, inflow control device 27 can take on many forms. Inflow control device 2 of the embodiment of FIG. 2 can be a tubular member 31 having threaded pin connection 33 at a first end of tubular member 31, i.e. closer to toe 21 of lateral bore 17, and a threaded box connection 35 at a second end of tubular member 31, i.e. closer to heel 19 of lateral bore 17. Tubular member 31 defines a central bore 37 having an axis 39. Production tubing string 25 can couple to tubular member 31 at threaded connections 33, 35 so that fluid, such as reservoir fluid, drilling fluid, cleaning fluid, or the like can be circulated through central bore 37.

A tubular housing 41 encircles tubular member 31. Tubular housing 41 will have an inner diameter greater than outer diameter of tubular member 31 to form an annulus 43 between tubular member 31 and tubular housing 41. Tubular housing 41 has an annular recess or opening 45 in fluid communication with annulus 43. A filter media 47 will be positioned within annular opening 45 so that fluid in casing string 15 or lateral bore 17 can flow into annulus 43 through filter media 47. Filter media 47 can be any suitable media type such as a wire screen or the like, provided the selected media prevents flow of undesired particulate matter from lateral bore 17 into annulus 43. Although described herein as separate components, tubular housing 41 and tubular member 31 can be integral components formed as a single body.

In the illustrated embodiment of FIG. 2, annulus 43 can define a fluid collecting chamber 49. Fluid collecting chamber 49 is an annular chamber proximate to opening 45 and filter media 47. Fluid can flow from lateral bore 17 through filter media 47 and into fluid collecting chamber 49. A plurality of isolated passages 51 can extend along tubular member 31. The outflow of each isolated passage 51 is in fluid communication with a nozzle 57 which is in fluid communication with the central bore 37. Nozzle 5 extends through a side wall 59 of tubular member 31 to allow fluid communication with central bore 37. Poppers 61 are located within each nozzle 57. Tubular member 31 can have a plurality of nozzles 57.

In certain embodiment each isolated passage 51 can include flow restrictors 53 and a pressure drop device 55 positioned within isolated passage 51. Fluid flowing through isolated passage 51 will pass through restrictors 53 and into pressure drop device 55. Fluid flowing through pressure drop device 55 can then flow out of nozzle 57 into central bore 37.

As discussed above, although an embodiment of inflow control device 27 is described herein in detail, poppers 59 can be located within a nozzle of any other style of inflow control device having an opening, or nozzle, that opens into the central bore 37. Inflow control device 27 can be, for example, as simple as a tubular member with nozzles situated in the wall of such tubular member to allow for the flow of fluids from the lateral bore 17, or wellbore 13, 13' as applicable, into the central bore 37 of production tubing string 25.

Figure 3:
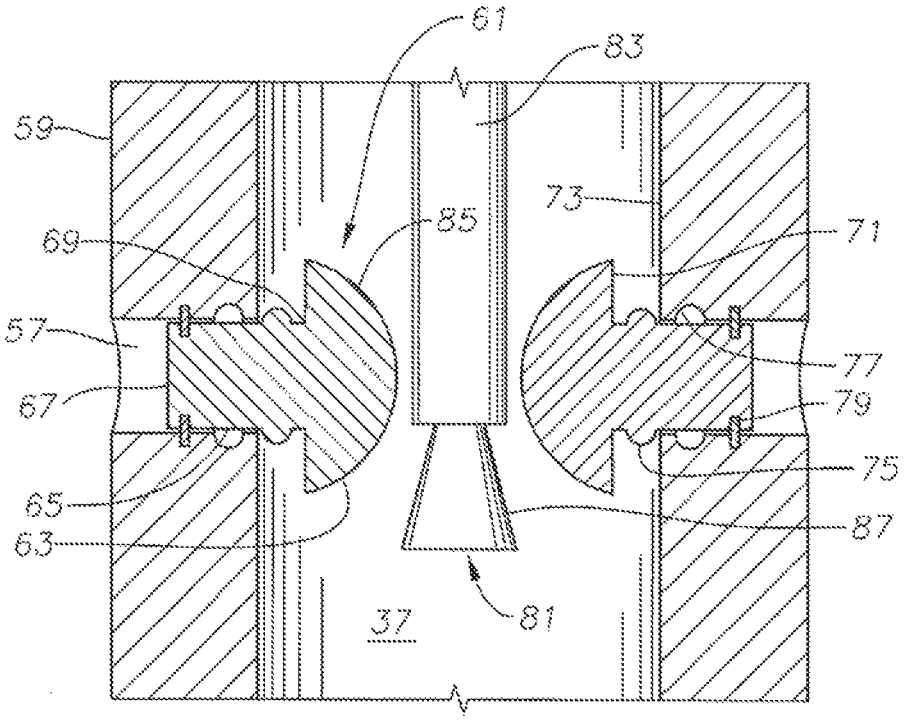
FIG. 3 is a sectional view of a portion of the inflow control device and tool in accordance with an embodiment of the present invention, with the popper in an open position.

Turning to FIG. 3, popper 61 has a bat 63 and a stem 65. An outer diameter of stem 65 is less than an inner diameter of the nozzle 57. Stem 65 has a first end 67 which is located within nozzle 57. Hat 63 is located at a second end 69 of the stem 65. Hat 63 has an outward feeing surface 71 for sealingly contacting an inner surface 73 of the central bore. In order to create an effective seal, the outward facing surface 71 can have a diameter that is greater than the inner diameter of the nozzle. Hat 63 has an inward facing surface 85. Inward facing surface 85 of hat 63 can be generally semi-spherical in shape.

Figure 4:
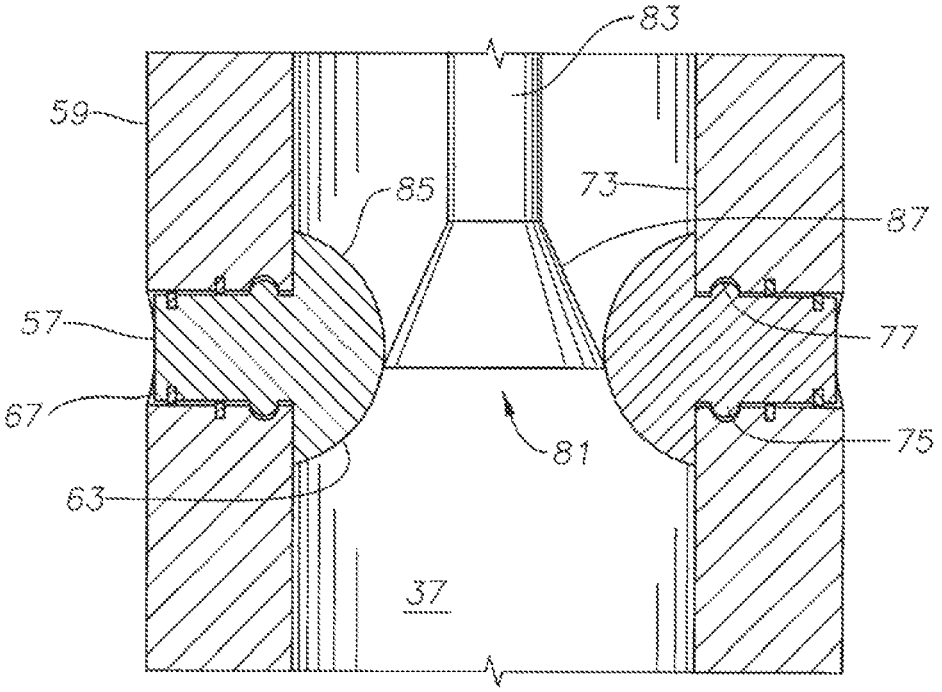
FIG. 4 is a sectional view of a portion of the inflow control device and tool in accordance with an embodiment of the present invention, with the popper In a closed position.

Each popper 61 has an external head profile 75 located on its stem 65. Profile 75 extends circumferentially around stem 65. Each nozzle 57 has an internal circumferential groove 77 which is shaped to mate with head profile 75 of stem 65. As can be seen in FIGS. 3 and 4, such shape can have, for example, a generally semi-circular cross section, or can have a cross section that is generally curved shape which extends beyond 180 degrees.

A shear member 79 can support each popper 61 in an open position within a nozzle 57. The shear member 79 can be disposed between the stem 65 of the popper 61 and an inner surface of the nozzle 57. The poppers 61 are shown in the open position in FIG. 3 and in the closed position in FIG. 4.

Looking at FIGS. 1-2, in operation, the threaded pin 33 at the first end of tubular member 31 and the threaded box 35 of the second end of tubular member 31 can be connected to production tubing string 25 and situated within wellbore 13. One or more tubular members 31 can be located within each production zone. When the operator desires to seal off a particular zone, a tool with an inflatable vessel 81 can be lowered through the production tubing string 25 and into the tubular member 31. This can be accomplished, for example, by attaching the tool with inflatable vessel 81 to coiled tubing 83 and lowering the coiled tubing 83 into the production tubing string 25. The inflatable vessel 81 can be lowered past the popper 61 that the operator wishes to move to a closed position. The inflatable vessel 81 is sized such that when it is not inflated, it can pass by poppers 61 which are in an open position without contacting the poppers 61 with sufficient force to move them to a closed position.

Turning to FIG. 4, when the inflatable vessel 81 has reached the desired position, the operator can pressurize coiled tubing 83 which will inflate inflatable vessel 81 and cause inflatable vessel to expand in diameter. The operator can then begin retrieving coiled tubing 83, pulling the inflatable vessel 18 past certain poppers 61 while inflatable vessel 81 remains in an inflated condition. In its inflated condition, the diameter of inflatable vessel 81 is such that it will contact hat 63 of poppers 61. Inflatable vessel 81 can have a sloped outer conical surface 87 so that as conical surface 87 of inflatable vessel 81 moves along inward facing surface 85 of hat 63, the contact between the surfaces 87, 85 causes popper 61 to move continually further into nozzle 57 until shear member 79 is broken and head profile 75 of stem 65 is located within, and fully mated with, internal circumferential groove 77 of nozzle 57.

The affected poppers 61 are now in the closed position, as shown in FIG. 4. When in the closed position, popper 61 fluidly seals nozzle 57 so that fluids from the wellbore 13 can not enter central bore 37 of production tubing string 25. In the closed position, outward surface 71 of popper 61 will sealingly contact inner surface 73 of central bore 37. When all of the poppers 61 of a particular inflow control device 27 are in this closed position, the inflow control device 27 acts as a blank pipe and no fluid from the subterranean fluid reservoir can enter the production tubing string 25 through such inflow control device 27. The mating of head profile 75 of stem 65 with internal circumferential groove 77 of nozzle 57 will maintain popper 61 in the closed position.

Once the desired poppers 61 have been moved to a closed position, the inflatable vessel 81 can be deflated by de-pressurizing coded tubing 83. The coiled tubing 83 and inflatable vessel 81 can then be returned to the surface. The inflow control device 2 which has poppers 61 in a closed position can now be pressure tested to determine its integrity and wellness and confirm the complete isolation of inflow control device 27.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A device for controlling fluid flow from a subsurface fluid reservoir into a production tubing string, the device comprising:

a tubular member defining a central bore, wherein a first end and a second end of the tubular member are coupled to the production tubing string, at least one nozzle extending through a side wall of the tubular member;

a popper, wherein the popper is moveable between an open position where fluids can flow into the central bore through the nozzle, and a closed position where the nozzle is fluidly sealed, the popper comprising:

a stem with an outer diameter less than an inner diameter of the nozzle;

a hat located at an end of the stem, wherein the hat has an inward facing hat surface for contacting an outer tool surface of an inflatable vessel to move the popper from an open position to a closed position; and a circumferential external head profile located on the stem; and a circumferential groove located in the nozzle for mating with the head profile of the stem and maintaining the popper in a closed position after the popper is moved from the open position to the closed position.

2. The device of claim 1 further comprising a shear member disposed between the stem of the popper and an inner surface of the nozzle for supporting the popper in an open position before the popper is moved to the closed position.

3. The device of claim 1, wherein the inward facing hat surface is semi-spherical and the outer tool surface is conical.

4. The device of claim 1, wherein the hat has an outward facing hat surface for sealingly contacting an inner bore surface of the central bore, the outward facing hat surface having a diameter greater than the inner diameter of the nozzle.

5. An inflow control device for controlling fluid flow from a subsurface fluid reservoir into a production tubing string, the inflow control device comprising:

a tubular member defining a central bore;

a plurality of isolated passages extending along the tubular member, wherein an outflow of each isolated passage is in fluid communication with a nozzle which is in fluid communication with the central bore;

an annular opening defined by the tubular member near an upstream end of the inflow control device, the annular opening allowing fluid communication between the subsurface fluid reservoir and the plurality of isolated passages;

a popper, wherein the popper is moveable between an open position where fluids can flow into the central bore through the nozzle, and a closed position where the nozzle is fluidly sealed; and a shear member disposed between the stem of the popper and an inner surface of the nozzle for supporting the popper in an open position.

6. The inflow control device of claim 5, wherein the popper comprises:

a stem having a first end and a second end;

a hat located at a second end of the stem; and a circumferential external head profile located on the stem.

7. The inflow control device of claim 6, further comprising a circumferential groove located in the nozzle for mating with the head profile of the stem and maintaining the popper in a closed position after the popper is moved from the open position to the closed position.

8. The inflow control device of claim 6, wherein the hat has an inward facing hat surface for contacting an outer tool surface of an inflatable vessel to move the popper from an open position to a closed position.

9. The inflow control device of claim 6, wherein the hat has an outward facing hat surface for sealingly contacting an inner bore surface of the central bore, the outward facing hat surface having a diameter greater than the inner diameter of the nozzle.

10. The inflow control device of claim 6, wherein the stem has an outer diameter less than an inner diameter of the nozzle and the first end of the stem is located within the nozzle in both the open and closed position.

11. A method for sealing fluid flow from a subsurface fluid reservoir into a production tubing string, the method comprising the steps of:

(a) connecting to the production tubing string a first and second end of a tubular member having central bore with an axis and at least one nozzle extending through a side wall, the nozzle having a popper located therein;

(b) lowering a tool with an inflatable vessel through the production tubing string and into the tubular member;

(c) pressurizing the tool to expand the inflatable vessel; and (d) pulling the inflatable vessel past the at least one nozzle to contact a hat of the popper and push a circumferential external head profile located on a stem of the popper into a circumferential groove located in the nozzle and move the popper from an open position where reservoir fluids can flow into the central bore through the nozzle, to a closed position where the nozzle is fluidly sealed.

12. The method of claim 11, further comprising the step of deflating the inflatable vessel and raising the inflatable vessel up through the production tubing.

13. The method of claim 11, further comprising the step of pressure testing the tubular member.

14. The method of claim 11, wherein the tubular member has a shear member disposed between the stem of the popper and an inner surface of the nozzle for supporting the popper in an open position and step (d) comprises breaking the shear member.

15. The method of claim 11, wherein the step of pushing the head profile into the circumferential groove comprises contacting an inward facing semi-spherical surface of the popper with an outer facing conical surface of the inflatable vessel.

16. The method of claim 11, wherein step (d) further comprises pushing the popper into the nozzle until an outward surface of the hat sealingly contacts an inner surface of the central bore.

17. The method of claim 11, wherein step (d) comprises pulling the inflatable vessel in a direction co-axial to the axis of the central bore.

18. The method of claim 11, wherein step (b) comprises lowering the inflatable vessel on coiled tubing.

* * * * *